US006756328B2

(12) United States Patent
Sakuma et al.

(10) Patent No.: US 6,756,328 B2
(45) Date of Patent: Jun. 29, 2004

(54) REINFORCED CATION EXCHANGE MEMBRANE AND PRODUCTION PROCESS THEREOF

(75) Inventors: Yuichi Sakuma, Kawasaki (JP); Toshinori Hirano, Yokohama (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 09/951,214

(22) Filed: Sep. 11, 2001

(65) Prior Publication Data

US 2002/0034904 A1 Mar. 21, 2002

(30) Foreign Application Priority Data

Sep. 11, 2000 (JP) ..... 2000-275042

(51) Int. Cl.[7] ..... B32B 3/00

(52) U.S. Cl. ..... 442/121; 428/304.4; 428/314.2; 264/41

(58) Field of Search ..... 442/121; 428/304.4, 428/314.2; 264/41

(56) References Cited

U.S. PATENT DOCUMENTS 4,437,951 A * 3/1984 Bissot et al. ..... 205/521

FOREIGN PATENT DOCUMENTS

JP 61-211344 * 9/1986

* cited by examiner

*Primary Examiner*—Elizabeth M Cole
(74) *Attorney, Agent, or Firm*—Birch, Stewart, Kolasch & Birch, LLP

(57) ABSTRACT

A cation exchange membrane wherein a plain weave reinforced cloth is embedded in a fluorinated polymer having a sulfonic acid group and/or a carboxylic acid group, characterized by possessing therein a tubular path which is formed in a direction of a warp and a weft of the plain weave reinforced cloth and has a cross section flat to a direction of thickness of the membrane.

10 Claims, 2 Drawing Sheets

REINFORCED CATION EXCHANGE MEMBRANE AND PRODUCTION PROCESS THEREOF

BACKGROUND OF THE INVENTION (1) Field of the Invention

The present invention relates to an ion exchange membrane for electrolysis, more specifically to an ion exchange membrane reinforced with a cloth comprising reinforcement threads and sacrificial threads which are used for electrolysis of an alkali metal chloride aqueous solution. Particularly, it relates to a fluorine-containing type ion exchange membrane having an excellent electro-chemical property and an excellent mechanical property which prevents an anode solution from leaking out of a system through a channel after dissolution of sacrificial threads in the membrane.

(2) Description of the Related Art

It is already known in this field that as a solid electrolyte used for a membrane for separation in electrolysis of an alkali metal chloride, laminated membranes of at least two layers containing a perfluorocarbon carboxylic acid layer and a perfluorocarbon sulfonic acid layer are effective. High current efficiency, low electric resistance of a membrane, and easiness of handling are demanded of these ionic membranes, and therefore it is essential for a membrane to have sufficient mechanical strength. However, this perfluorocarbon type film has low tear strength, and does not endure a use for a long period by itself, and therefore tear strength thereof is improved usually by embedding a reinforcing material such as a reinforced cloth, etc. in the film.

However, a general reinforcing material is ionically non-permeable, and therefore when the reinforcing material is embedded in the film, a decrease of an effective electric current area and a raise of electric voltage for electrolysis accompanied thereby are caused on electrolysis. This inclination becomes more remarkable when a structure is made to be dense to raise a reinforcing effect, or a yarn composing the reinforcing material is made to be thick. Moreover, a yarn being made to be thick means that a resinous amount of a membrane to wrap the yarn itself is increased, and it further leads to an increase of electric resistance of the membrane.

To overcome a contradictory relation as above of high mechanical strength of a membrane and low electric resistance of a membrane, various attempts have been conventionally conducted. First of all, an attempt was carried out, namely, a method wherein a structure of a fabric is made to be coarse, and an openness (the total area of windows (apertures among fibers) relative to the total area of the structure of the fabric is represented by a percentage) is enlarged. Generally, in electrolysis of an alkali metal chloride under high electric current density, when the openness is made to be not higher than 70%, an effective electric current area of a membrane becomes short, and not only electric resistance of a membrane is increased, but also a transfer of impurities is locally increased, which causes a decrease of efficiency of electric current. Therefore, usually the openness of not lower than 70% is thought to be necessary.

Then, as an attempt to obtain a reinforced cloth having both high mechanical strength and a large openness, there are proposed a membrane wherein a leno weave cloth highly preventing slippage of stitch is adopted as a cloth, and a yarn of a multi-filament of a perfluoro-polymer having a specified denier is adopted as a yarn used (JP-A-61-7338), and further, a method wherein, after manufacturing the plain weave cloth which has been obtained by mixedly weaving reinforcement threads of a perfluoro-polymer and sacrificial threads soluble in an alkali solution, the sacrificial threads are dissolved, and the only reinforcement threads which remain are inserted between films of a laminate (JP-A-64-55393). However, even by employing these methods as above, an openness of approximately 70% is at most, and when the openness of not lower than 70% is tried to attain, slippage of a stitch at a part of openings of a cloth is caused, which makes difficult a production of a cloth, and insertion thereof between films of a laminate.

Furthermore, there is proposed a cloth using, instead of sacrificial threads, a yarn having a raised apparent specific gravity by improving a commercially available yarn of polytetrafluoroethylene (PTFE) having porosity. However, employment of only the reinforcement threads is limitative to raising of openness (JP-A-3-217427).

Thus, a method is proposed wherein the plain weave reinforced cloth which has been obtained by mixedly weaving a reinforce yarn of a perfluoro-polymer and a sacrifice yarn which is soluble on use in an electrolysis cell, or is soluble by a chemical treatment such as with an acid or an alkali solution, is inserted between films of a laminate, and then the sacrificial threads in the cloth are dissolved by the chemical treatment as described above (JP-A-1-308435 and JP-A-63-113029). By mixedly weaving with sacrificial threads, even when the openness at a portion of reinforcement threads is high, this cloth maintains favorable prevention from slippage of a stitch. Further, since sacrificial threads are dissolved while remaining in a membrane, at the part where the sacrificial threads originally occupied, a void channel (hereinafter referred to as "a channel after dissolution of sacrificial threads") is produced in the membrane. Moreover, by making the position of the cloth in the membrane close to the side of the membrane which is in contact with an anode solution, a minute cleft (hereinafter referred to as "penetrating channel") is caused on the surface of the membrane, and by conducting the anode solution thorough the penetrating channel to a continuous tubular path which has been formed by a channel after dissolution of sacrificial threads at an inner part of the membrane, the anode solution can be filled to the part where an ionic transfer has been prevented by the reinforcement threads and the layer where the tubular path resides. Resultantly, electric resistance of a membrane can be reduced.

However, there is such a problem that the tubular path is in connection with the whole of the cloth, namely with the whole of the membrane, on use in an electrolysis cell, a portion of the anode solution is apt to bleed out of a flange which fixes a membrane to the electrolysis cell, and thus a leak of the anode solution from the circumference of the membrane is caused. This leak of the anode solution out of the vessel accelerates corrosion of an electrolysis cell and deterioration of a gasket, and, in the worst case, a short circuit is caused owing to a precipitation of a salt, and electrolysis sometimes is forced to be terminated. Particularly, pressure on the surface of the flange in the longitudinal direction of the electrolysis cell sometimes is not uniform, and leak especially from the lower part of the electrolysis cell can be caused. Therefore, when the electrolysis cell is equipped with a membrane, a channel after dissolution at the flange part is clogged, for instance, by applying a pasty silicone sealant or a fluorine type grease to the gasket. However, depending upon the shape of an electrolysis cell, the coating takes much time and labor, and when thickness of the coating is not uniform, the sealant or the grease may protrude to an electric current conducting portion and an electrolysis cell, which are a problem.

SUMMURY OF THE INVENTION

The task of the present invention is to provide a cation exchange membrane using a plain weave reinforced cloth, and a process of a production thereof, wherein the membrane has a channel(s) after dissolution which is(are) formed at a part(s) where sacrificial threads have been dissolved, has a continuous tubular path(s) formed thereby, and on use of an electrolysis cell, no leak of an anode solution can be seen out of the membrane through the channel(s) after dissolution and the tubular path(s).

The present inventors have intensively studied to solve the problems as stated above, and as a result, they have found that, when the shape of a cross section of a channel after dissolution which is formed at a part where sacrificial threads have been dissolved, is made to be flat in a direction of a plane of the membrane, remarkable effect can be exhibited to solve the problems as stated above. Thus, the present invention has been accomplished.

Namely, the present invention relates to:

(1) A cation exchange membrane wherein a plain weave reinforced cloth is embedded in a fluorinated polymer having a sulfonic acid group and/or a carboxylic acid group, characterized by possessing therein a tubular path which is formed in a direction of a warp and a weft of the plain weave reinforced cloth and has a cross section flat to a direction of thickness of the membrane;

(2) The cation exchange membrane according to the above-described (1), wherein the tubular path has been formed by dissolution of sacrificial threads, and the sacrificial threads are of 20 to 50 denier and consists of a multi-filament composed of 4 to 8 mono-filaments and having a circular cross section;

(3) The cation exchange membrane according to the above-described (1), wherein a thickness of the plain weave reinforced cloth is from 30 to 80 $\mu$m;

(4) The cation exchange membrane according to the above-described (1), wherein reinforcement threads of the plain weave reinforced cloth are stretched yarn of a polytetrafluoroethylene having a circular cross section and having a specific gravity of 2.0 to 2.3;

(5) A process for producing a cation exchange membrane having therein a tubular path, characterized in that a plain weave reinforced cloth which has been mixedly weaved with reinforcement threads and sacrificial threads, and wherein the sacrificial threads are flat parallel to a plane of the cloth, or mono-filaments composing the sacrificial threads reside in a row without overlapping one another in the direction of thickness of the cloth, is embedded in a fluorinated polymer having a sulfonic acid group and/or a carboxylic acid group, to form a membrane, and thereafter the membrane is hydrolyzed and at the same time the sacrificial threads are dissolved with an acid or an alkali;

(6) The process for producing a cation exchange membrane according to the above-described (5), wherein a number of twisting of the sacrificial threads of the warp is not higher than 250 times/m, and a number of twisting of the sacrificial threads of the weft is not higher than 200 times/m;

(7) The process for producing a cation exchange membrane according to the above-described (5), wherein the sacrificial threads are composed of a multi-filament of polyethylene terephthalate;

(8) The process for producing a cation exchange membrane according to the above-described (5), wherein the sacrificial threads are of 20 to 50 denier and consist of a multi-filament composed of 4 to 8 mono-filaments and having a circular cross section;

(9) The process for producing a cation exchange membrane according to the above-described (5), wherein a shrinkage ratio of the sacrificial threads of the warp in boiling water is not lower than 6%, and a shrinkage ratio of the sacrificial threads of the weft in boiling water is not higher than 3%;

(10) The process for producing a cation exchange membrane according to the above-described (5), wherein a number of twisting of the sacrificial threads of the weft is higher than 0 times/m and not higher than 100 times/m;

(11) The process for producing a cation exchange membrane according to the above-described (5), wherein a thickness of the plain weave reinforced cloth is 30 to 80 $\mu$m; and

(12) A precursor of a cation exchange membrane wherein a plain weave reinforced cloth which, by employing sacrificial threads having a number of twisting of not higher than 250 times/m as a warp, and sacrificial threads having a number of twisting of not higher than 200 times/m as a weft, has been prepared by mixedly weaving them with reinforcement threads, is embedded in a fluorinated polymer having a sulfonic acid group and/or a carboxylic acid group, and the sacrificial threads are flat parallel to a plane of the membrane, or mono-filaments composing the sacrificial threads reside in a row without overlapping one another in a direction of thickness of the membrane and are in a continuous form in the direction of each of to the warp and the weft of the cloth.

The reinforced cloth according to the present invention can render the shape of a cross section of a channel after dissolution of sacrificial threads flat in a direction of a plane of the membrane, the channel after dissolution can be easily crushed at a portion of a cell flange of an electrolysis cell, the effect of preventing leak of an anode solution out of the cell flange can be exhibited. Thereby, the conventional applying of a silicone sealant or a fluorine type grease becomes unnecessary, and easy setting of the membrane to an electrolysis cell becomes possible.

BRIF DESCRIPTION OF THE DRAWINGS

Figure 1:
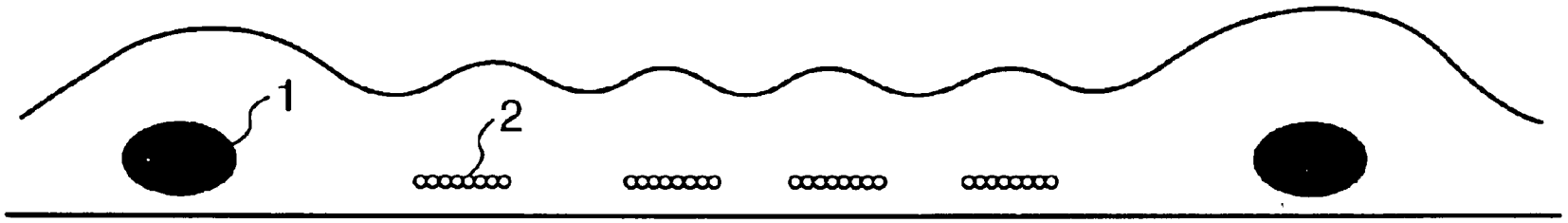
FIG. 1 shows a schematic drawing of cross section of a portion of an ion exchange membrane before hydrolysis in Example 1.

In FIGS., 1 means reinforcement threads of polytetrafluoroethylene, and 2 means sacrificial threads of polyethylene terephthalate.

PREFERRED EMBODIMENT OF THE INVENTION

Hereinafter, the present invention is explained in detail.

The plain weave reinforced cloth employed according to the present invention is inserted between the layers of a laminated membrane for electrolysis and performs a function as a reinforcing material of the membrane, and is a fabric composed of reinforcement threads and sacrificial threads.

The reinforcement threads mean threads which maintain strength of a membrane for electrolysis and restrain a dimensional change thereof as remaining threads composing a cloth after sacrificial threads are dissolved by a method as referred to below. Preferred are reinforcement threads which have resistance under conditions for using a membrane in an electrolysis cell, for instance, under a high temperature, and in the presence of chlorine, sodium hypochlorite, and sodium hydroxide of high concentration in electrolysis of sodium chloride. As a yarn which satisfies a mechanical property, thermal resistance, and chemical resistance as above, for example, a perfluorocarbon type yarn is suitable. Further, as a preferable shape in case of considering improving of tear strength of a membrane, a tape yarn of 50 to 200 denier may be used which has been prepared by slitting a sheet composed of a polytetrafluoroethylene having high strength and porosity into a tape-like shape, as is disclosed in JPB-56-17216. Furthermore, in order to decrease a sectional area of a yarn, and to increase an effective electric current conducting area, preferable is use of a stretched yarn of polytetrafluoroethylene having a circular section, having a specific gravity of 2.0 to 2.3, and being of 50 to 200 denier, especially 50 to 100 denier, as is disclosed in JP-A-2-127509 and U.S Pat. No. 5,364,699.

For the purpose of acquiring folding endurance of a membrane, and of making the thickness of the reinforced cloth small, the cross section of reinforcement threads is preferred to have an appropriate aspect ratio (an aspect ratio=width/thickness of reinforce yarn), the ratio being preferably 2 to 20, particularly preferably 3 to 10. When a taped yarn is used, on weaving a cloth, usually the yarn is twisted and once a cross section of the yarn is made circular. However, flattening thereafter is conducted by a calendering treatment between heated metallic rolls after weaving the cloth. Exceptionally, when a stretched yarn of polytetrafluoroethylene having a circular section, having sufficiently small denier, and having a high specific gravity, is used, an aspect ratio thereof of 1 may be possible.

The sacrificial threads mean such threads that a part or the whole thereof is dissolved on use in an electrolysis cell, or in a chemical treatment with an acid or an alkali, and a void channel (a channel after dissolution of sacrificial threads) is generated at the part where the threads have been dissolved. As the material of the sacrificial threads, polyethylene terephthalate, rayon, and cellulose, etc. are used, and particularly preferred is a multi-filament of polyethylene terephthalate, which has abundant species thereof.

Figure 3:
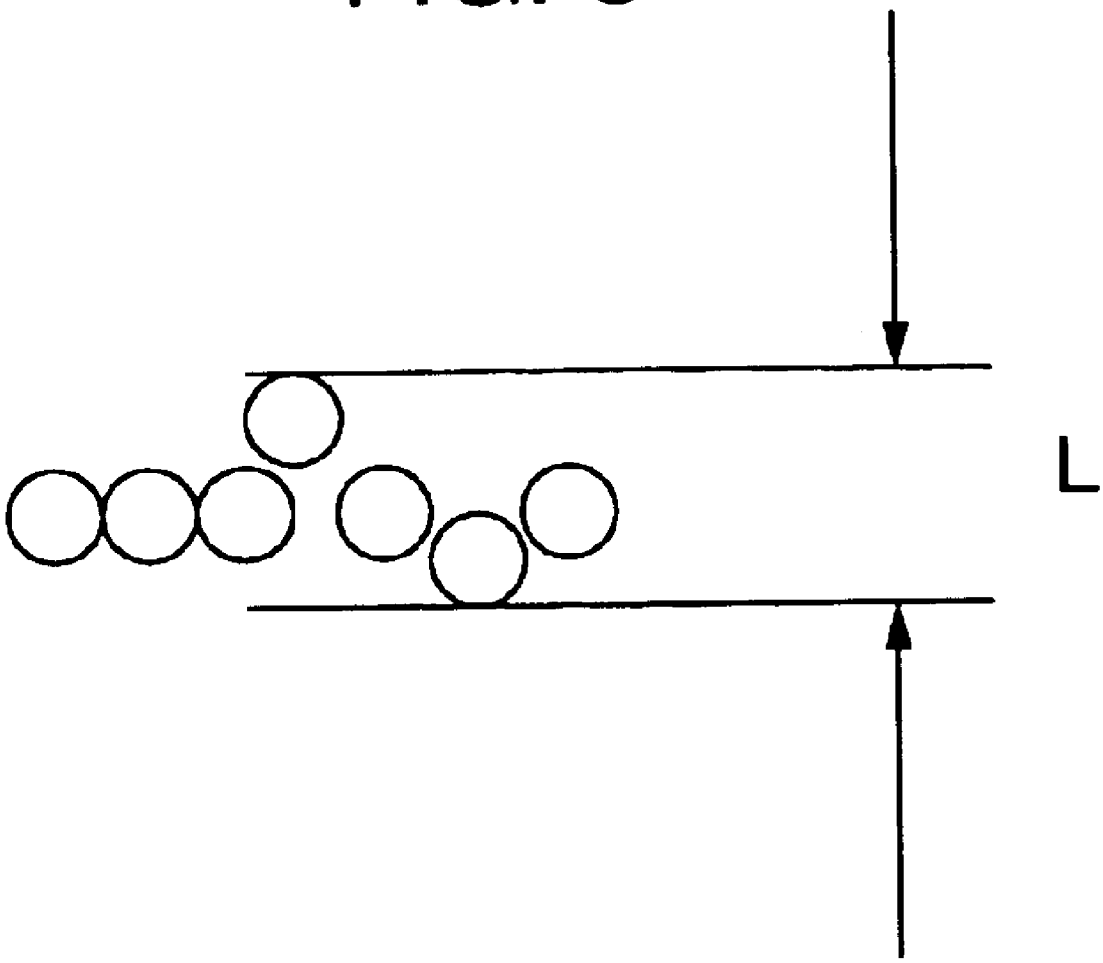
FIG. 3 shows a schematic drawing of cross section of sacrificial threads or a channel after dissolution of sacrificial threads.

To prevent a leak of an anode solution through a channel after dissolution of sacrificial threads, the channel and a tubular path formed are required to be crushed at a portion of a cell flange, and openings out of the cell flange must completely be clogged. According to the present invention, as a shape of the channel after dissolution of sacrificial threads and the tubular path which are easily crushed at a portion of a cell flange, the cross section thereof must be flat in a direction of a plane of a membrane. In accordance therewith, a gathering structure of mono-filaments is required to be controlled so that the section of sacrificial threads composing the reinforced cloth is flat in the direction of the plane of the cloth. Herein, a cross section flat in the direction of the plane of the membrane or in the direction of the plane of the cloth means that the shape of a cross section of a channel after dissolution of sacrificial threads or of sacrificial threads is approximately elliptic, and the longitudinal axis defining the ellipse is approximately parallel to the plane of the membrane or to the plane of the cloth. Specifically, it can be represented by the degree of flatness of the cross section of sacrificial threads or of a channel after dissolution of sacrificial threads, as is shown in FIG. 3.

The degree of flatness of the cross section of sacrificial threads or of a channel after dissolution of sacrificial threads is represented by either of a ratio of a height L of the whole of a section of sacrificial threads to a diameter of a mono-filament of the sacrificial threads, or a ratio of a height of a channel after dissolution of sacrificial threads to a diameter of a portion after dissolution corresponding to a mono-filament composing a channel after dissolution of sacrificial threads.

The degree of flatness is not higher than 2, preferably not higher than 1.5. This means that a part of sacrificial threads is overlapping by a portion corresponding to a radius thereof in the preferable state. A particularly preferable gathering structure of the sacrificial threads is, for example, as is shown in FIG. 1, the gathering structure wherein mono-filaments thereof reside in a row without overlapping one another in the direction of thickness of the membrane, and in the case of FIG. 1, the degree of flatness is 1. Herein, a cross section of the sacrificial threads composing a reinforced cloth, namely the gathering structure of the sacrificial threads can be confirmed by an observation of the membrane from the direction of a cross section and flatwise thereof after the plain weave reinforced cloth has been inserted between layers of a laminated membrane for electrolysis, and before it is hydrolyzed and the sacrificial threads are dissolved. Confirming of a shape of a cross section of a channel after dissolution of sacrificial threads is conducted on a final product in a dry state. The reason is that usually, the final product is supplied in a wet state, but by swelling of a resin, a diameter of a mono-filament of sacrificial threads after a channel after dissolution of sacrificial threads is formed, is inclined to be larger than a diameter thereof used on weaving a cloth.

As a method of controlling the gathering structure of the sacrificial threads as described above, determining of a twisting number of the sacrificial threads on weaving a cloth is exemplified. In this case, a cloth is preferably weaved while twisting not more than 250 times per 1 m is provided to a warp, and twisting not more than 200 times per 1 m is provided to a weft.

From the viewpoint of weaving a cloth, a warp is preferably twisted 100 to 350 times, more preferably 100 to 250 times per 1 m. However, when threads are sized after twisting a yarn, twisting of a low number of not more than 100 times is possible. Considering a balance of prevention of a leak of an anode solution and weaving of a cloth, using of a yarn which is twisted not more than 50 times and then sized, is particularly preferable.

On the other hand, a weft is most preferably not twisted from the viewpoint of prevention of a leak of an anode solution. However, twisting not more than 200 times when the viewpoint of weaving a cloth is considered, twisting not more than 100 times in order to accurately provide a function of preventing a leak of an anode solution, and twisting not more than 50 times from a balance of a function of preventing the leak and weaving of a cloth, are respectively more preferable.

Figure 2:
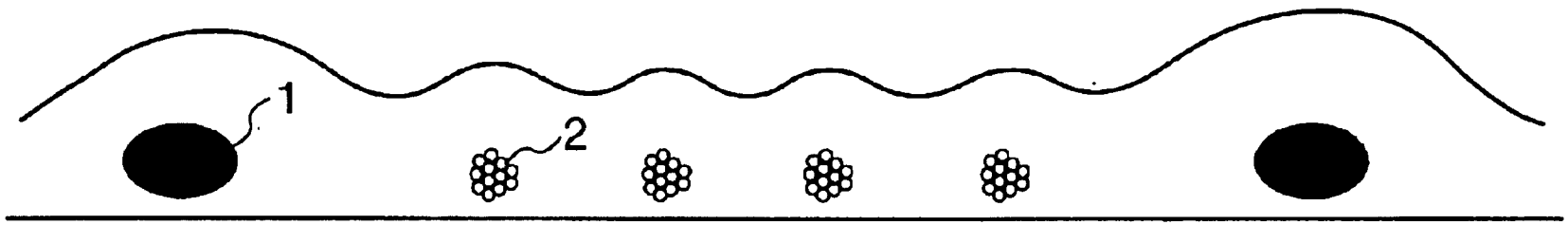
FIG. 2 shows a schematic drawing of cross section of a portion of an ion exchange membrane before hydrolysis in Comparative Example 1.

When the number of twisting (twisting number) becomes larger, as is shown in FIG. 2, overlapping of mono-filaments by the twisting becomes more, and the flatness of a cross section of the sacrificial threads is lost, and finally the flatness of the whole of a channel after dissolution of sacrificial threads and a tubular path is lost.

Herein, the twisting number of the sacrificial threads means that of twisting in a direction of S letter or Z letter with a general twisting machine, and concerning the twisting which is given from a packed state of sacrificial threads (a pirn or a cheese) to a reeling step of a yarn in a step to weaving of a cloth, the number thereof is not added to the twisting number.

On the other hand, a weaving property of a cloth means the number of terminations of a weaving machine when the plain weave reinforced cloth is weaved, the number of the terminations owing to sacrificial threads is calculated per 1000 m thereof. In other words, a favorable weaving property of a cloth means a small number of the terminations.

The channel after dissolution of sacrifice yarn is preferably flat at the side of a warp as well as at the side of a weft, but reducing the twisting number of both at the side of a warp and at the side of a weft sometimes is limited from the viewpoint of a weaving property of a cloth. In this case, the twisting number is preferably reduced so that a yarn wherein a cross section of a channel after dissolution of sacrifice yarn resides at the long side of a cell when a general 4×8 ft electrolysis cell is equipped therewith, that is generally a weft, is made to be flat.

A warp and a weft of sacrificial threads in the plain weave reinforced cloth have the same directions as a warp and a weft of a general cloth, respectively, and in this case, a yarn residing in the longitudinal direction of a cloth is called a warp. That is, a warp and a weft orthogonally cross in a structure of a cloth. Therefore, it is preferable to reduce the twisting number so as to flatten the side of a weft, but reducing the twisting number so as to flatten the side of a warp also is included. By observing a final product after being made dry, a state of a twisted yarn can be detected from a shape of a cross section of a channel after dissolution of sacrificial threads and of a tubular path.

Further, as a method of controlling the gathering structure of sacrificial threads, by making the number of mono-filaments composing sacrificial threads 4 to 8 and making the shape of a cross section of each of the mono-filaments circular, the sacrificial threads can be made to reside in a row in a plane of the cloth after the plain weave reinforced cloth is weaved. When the number of mono-filaments is smaller than the above, a denier per a mono-filament is increased, and a sectional area of the filament becomes larger, and even when the mono-filaments are made to reside in a row, flatness of a cross section of the sacrificial threads becomes inferior. On the other hand, when the number of mono-filaments is too many, even in the case of a low twisting number thereof, overlapping of mono-filaments one another is increased, as is shown in FIG. 2. For the purpose of increasing contacting points of mono-filaments one another and providing a tubular path as a continuous void after the sacrificial threads are dissolved, the cross section of a mono-filament is preferably circular.

The thickness of the sacrificial threads change depending upon the thickness of the whole cloth and an openness, and usually is preferably 20 to 50 denier. When it is thinner than 20 denier, sufficient void as a channel after dissolution of sacrificial threads and a tubular path cannot be obtained. On the other hand, when it is thicker than 50 denier, a channel after dissolution of sacrificial threads and a tubular path become hard to be crushed.

The number of reinforcement threads embedded in the cloth according to the present invention is 8 to 32/inch, though it differs depending upon the thickness of the reinforcement threads and an openness of a cloth of interest. The number is preferably 12 to 18/inch, when it is specified to a taped yarn having a thickness of 100 to 150 denier. The number is more preferably 16 to 32/inch, when a stretched yarn of polytetrafluoroethylene having a circular cross section and having a thickness of 50 to 100 denier. Concerning a ratio of the number of reinforcement threads and the number of sacrificial threads embedded in the cloth, it is essential that the number of sacrificial threads is an even number times of the number of reinforcement threads. If the number of sacrificial threads is an odd number times of the number of reinforcement threads, after sacrificial threads are dissolved, entanglement of a warp and a weft of reinforcement threads are lost. And the both threads are merely mixed with one another in a plane, and the structure of a plain weave cloth is not formed, which is not practical. The ratio is 2 to 8 times based on the number of reinforcement threads. From the standpoint of weaving a cloth and slippage of a stitch, the total number of reinforcement threads and sacrificial threads is preferably 60 to 100/inch.

An openness of reinforcement threads after sacrificial threads are dissolved, is preferably 70 to 90%, particularly preferably 80 to 90%. When the ratio is smaller than 70%, not only a raise of electric voltage for electrolysis of a membrane is caused, but also a substantial density of electric current of a portion divided by reinforcement threads is increased, and thus a decrease of efficiency of electric current is feared to incur. On the other hand, when the ratio is larger than 90%, a reinforcing effect of a membrane with a cloth is decreased.

In this connection, the openness can be confirmed by taking a photograph usually using an optical microscope.

The reinforced cloth obtained by the above-described method is preferred to be treated to flatten at a temperature of not lower than 200° C. after weaving a cloth to further improve flatness of a cross section of sacrificial threads and a cross section of reinforcement threads. A thickness thereof after the treatment is suitably 30 to 80 $\mu$m. When the cloth is too thick, flatness of a cross section of sacrificial threads may be deteriorated, and at the same time, smoothness of a membrane may be worsened. To smooth a cloth, generally a heat roll and a heat plate are used, though they are not limitative. A particularly preferable way is to continuously transfer a cloth and roll it between two heated rolls while providing tension in the direction of a warp thereof. Further, when a warp and a weft of sacrificial threads of a polyethylene terephthalate which have different thermal shrinkage each other, are used, overlapping of sacrificial threads of a multi-filament due to a thermal shrinkage thereof during a treatment of smoothing can be prevented, though they have resided in a row on weaving the cloth. For instance, as a warp a shrinkage of which can be controllable by providing tension, a yarn of a polyethylene terephthalate having a shrinkage in a boiling water of not less than 6%, and as a weft to which tension cannot be provided, a yarn of a polyethylene terephthalate having a shrinkage in a boiling water of not more than 3%, can be used, respectively.

Concerning an ionic membrane for electrolysis of an alkali chloride, it is well known that an adoption of a laminated structure is useful wherein a layer containing a carboxylic acid group which has high electric resistance but shows high efficiency of electric current, and a layer containing a sulfonic acid group which shows low electric resistance are comprised. Further, a membrane of a three-layer structure having a specified water content as in JP-A-5-98486 is important in providing a membrane exhibiting low electric voltage for electrolysis, high efficiency of electric current, and high strength.

The first layer containing a carboxylic acid group which faces to a cathode, employed according to the present invention, is composed of copolymers of at least two kinds of the monomers respectively represented by formulae (1) and (2) as below.

$$CF_2{=}CX_aX_b \quad (1)$$

(wherein $X_a$ and $X_b$ are F, Cl, H, or $CF_3$)

$$CF_2{=}CF(OCF_2CFX_c)_nO(CF_2)_mY \quad (2)$$

(wherein $X_c$ is F or $CF_3$, m is an integer of 1 to 3, n is 0 or 1, and Y is a precursor which is hydrolyzed in an alkaline medium to become a carboxylic acid group, and is selected from a carboxylic acid ester group —COOR (R is a lower alkyl group having 1 to 4 carbon atoms), a cyano group —CN, and an acid halide —COZ (Z is a halogen atom)).

Usually, as the monomer represented by formula (1), the following is suitably exemplified.

$$CF_2{=}CF_2$$

As the monomer represented by formula (2), a carboxylic acid ester group is adopted, and the representative examples thereof are shown as follows.

$$CF_2{=}CFOCF_2CF(CF_3)OCF_2CF_2COOCH_3$$

$$CF_2{=}CFOCF_2CF_2COOCH_3, \text{ and}$$

$$CF_2{=}CFOCF_2CF_2CF_2COOCH_3$$

An ion exchange capacity is preferably in the range of 0.7 to 0.95 meq/g, for instance, concerning a copolymer with $CF_2{=}CF_2$, for the purpose of high efficiency of electric current, and of reducing of a concentration of a salt in an alkali hydroxide produced, although it differs depending on a structure of a monomer of formula (2), a condition for hydrolysis, and a concentration of an alkali. Further, the thickness of the first layer is 5 to 40 μm, preferably 10 to 30 μm.

The second layer containing a sulfonic acid group is composed of copolymers of at least two kinds of the monomers represented by formula (1) and formula (3), respectively, as below.

$$CF_2{=}CF(OCF_2CFX_c)_nO(CF_2)_mW \quad (3)$$

(wherein $X_c$ is F or $CF_3$, m is an integer of 1 to 3, n is 0, 1, or 2, and W is a precursor which is hydrolyzed in an alkaline medium to become a sulfonic acid group, and is selected from a halogenated sulfonyl group —$SO_2X_d$ ($X_d$ is selected from F, Cl, and Br), and an alkyl sulfonic acid —$SO_2R$ (R is a lower alkyl group having 1 to 4 carbon atoms).

Usually, as the monomer represented by formula (3), one which has a sulfonyl fluoride group is suitably adopted, and as the representative examples thereof, the monomers as follows are shown.

$$CF_2{=}CFOCF_2CF(CF_3)OCF_2CF_2CF_2SO_2F,$$

$$CF_2{=}CFOCF_2CF(CF_3)OCF_2CF_2SO_2F,$$

$$CF_2{=}CFOCF_2CF_2CF_2SO_2F,$$

and $$CF_2{=}CFOCF_2CF_2SO_2F$$

An ion exchange capacity is preferably in the range of 0.9 to 1.1 meq/g, for instance, concerning a copolymer with $CF_2{=}CF_2$, for the purpose of strength of a membrane, and of reducing of a concentration of a salt in an alkali hydroxide produced, although it differs depending on a structure of a monomer of formula (3), a condition of hydrolysis, and a concentration of an alkali. In order to prevent a peeling off between the first and second layers during electrolysis, a difference in ion exchange capacity between the first and second layers is preferably as small as possible. Further, the thickness of the second layer controls strength and therefore should be 60 to 100 μm, preferably 70 to 90 μm.

The third layer containing a sulfonic acid group is preferably selected from polymers having the same structure as that of the second layer, and suitably has the same ion exchange capacity as or a higher ion exchange capacity than the second layer for the purpose of reducing electric voltage for electrolysis. Further, the thickness of the third layer should be preferably 10 to 30 μm for the purpose of effectively forming on a surface of the membrane a penetrating channel which is necessary for conducting an anode solution to a channel after dissolution of sacrificial threads and a tubular path. When it is not smaller than 30 μm, a penetrating channel is not formed, and an anode solution cannot be supplied to a channel after dissolution of sacrificial threads and a tubular path, and therefore resistance of a membrane is increased.

A method for producing a membrane according to the present invention is enabling by means of a known technique, for instance, a heat press molding, a roll molding and an extrusion molding. In the particularly preferable method, the first layer and the second layer are molded by a coextrusion molding method to provide a film, and the third layer is molded by a monolayer extrusion molding method to provide a film. For example, as disclosed in JP-A-56-99234, a film of the third layer, a plain weave reinforced cloth calendered, and a composite film of the second layer and the first layer are laminated in this order on a plate or a drum which has many small holes thereon, through a thermal resistant porous release paper having gas permeability with a heating source and a vacuum source provided. They are integrated under a temperature at which each of polymers are melted while removing air between the respective layers under a reduced pressure. Here, the coextrusion of the first layer and the second layer contributes to enhancing adhesive strength at the interfacial surface thereof. The method of integrating under a reduced pressure has, as compared with a thermal pressing method, an advantage that a thickness of the second layer on the reinforced cloth is made large, and a penetrating channel is easily formed on the surface of a membrane since the cloth enough intrudes also into the third layer.

A method of obtaining an ion exchange membrane by hydrolyzing an integrated laminate is enabling under known conditions. As an example of the preferable methods, there is a hydrolyzing method of using a water soluble organic compound and MOH (M is an alkali metal) as disclosed in JP-A-1-140987. There are some cases wherein a portion of sacrificial threads remains without being dissolved.

The membrane for electrolysis obtained by the above-described method may have, if necessary, a coating layer of an inorganic compound for prevention of attaching of a gas to the surface of a cathode side and to the surface of an anode side. The coating layer can be made by a known method. The method as disclosed in JP-A-3-137136 is preferred, wherein a liquid having fine particles of a certain inorganic oxide dispersed in a solution of a binder polymer, is applied by spray.

A method for finally judging a leak of an anode solution through a channel after dissolution of sacrificial threads is to provide a practically and commercially used electrolysis cell with a membrane and operate it. As an accelerating test, a leak can be confirmed by the method wherein a membrane cut in a size of 200 mm×200 mm is held in a small cell having a size of 170 mm×170 mm and having a flange width of 35 mm, to which a predetermined surface pressure can be given with a hydraulic press, and a sodium chloride aqueous solution having a concentration of 205 g/l is circulated at a temperature of 90° C. in both a cathode partition and an anode compartment, and when a pressure of air of 0.1 MPa is imposed, whether a salt has precipitated or not in the direction of a cross section of the membrane after an elapse of a predetermined time (4 hours or 8 hours) is studied.

The present invention is explained below in detail by referring to examples and comparative examples.

EXAMPLE 1

A taped yarn of a polytetrafluoroethylene (PTFE) of 150 denier was twisted at 900 times/m, and was made a filament-like to provide reinforcement threads. A yarn composed of 6 filaments of a polyethylene terephthalate (PET) of 30 denier and a ratio of shrinkage in a boiling water of 8% was twisted at 200 times/m to provide a warp of sacrificial threads. A yarn composed of 8 filaments of a polyethylene terephthalate (PET) of 35 denier and a ratio of shrinkage in a boiling water of 3% was twisted at 10 times/m to provide a weft thereof. By employing these yarns, a plain weave reinforced cloth was weaved so as to have reinforcement threads of PTFE at 16/inch, and to have sacrificement threads of PET at 64/inch, i.e. 4 times that of the former. The thickness of the cloth was 100 μm. During the weaving of the cloth, the number of terminations owing to a weft was 55 times/1000 m, and a fabricating property thereof was favorable.

After the weaving, the cloth was transferred between two heated metallic rolls to make a thickness thereof 68 μm for smoothing. An openness of only reinforcement threads of PTFE of the cloth was 75%.

A copolymer of $CF_2{=}CF_2$ and $CF_2{=}CFOCF_2CF(CF_3)OCF_2CF_2COOCH_3$ having an equivalent weight of 1100 (A), a copolymer of $CF_2{=}CF_2$ and $CF_2{=}CFOCF_2CF(CF_3)OCF_2CF_2SO_2F$ having an equivalent weight of 1030 (B), and a copolymer having the same structure as copolymer (B) and having an equivalent weight of 950 (C) were prepared. By using an apparatus equipped with two extruders, a T die for coextrusion, and a drawing machine with copolymer (A) and copolymer (B), a film of two layers (a) having a thickness of a layer of copolymer (A) of 25 μm and a thickness of a layer of copolymer (B)of 90 μm was obtained. Further, with a monolayer T die, a film (b) of a copolymer (C) having a thickness of 25 μm was obtained.

On a drum which has a heating source and a vacuum source inside and many small holes thereon, a porous release paper having gas permeability, a film (b), a reinforced cloth, and a film of two layers (a) so as to put a copolymer (B) to the side of the cloth are laminated in this order, and they are integrated at a temperature of 230° C. while removing air between the respective layers at a reduced pressure of −600 mmHg to obtain a composite membrane. As a result of observing a surface and a cross section of the membrane, a structure was observed wherein a shape of a cross section of sacrificial threads of a multi-filament is flat in the direction of a plane of the membrane, and particularly at the side of a weft, filaments reside in a row without overlapping one another in the direction of thickness of the membrane.

In a mixed solution of 50 parts by weight of water and 50 parts by weight of ethanol, a fluorine type polymer having a sulfonic acid group which polymer is prepared by hydrolyzing a copolymer of $CF_2{=}CF_2$ and $CF_2{=}CFOCF_2CF(CF_3)OCF_2CF_2SO_2F$ having an equivalent weight of 950 was dissolved by 5 wt %. Into the solution, zirconium oxide having a primary particle diameter of 0.02 μm was added by 20 wt %, and it was uniformly dispersed with a ball mill therein to obtain a suspension. This suspension was coated onto both surfaces of the above-described composite membrane by a spray method, and dried to form a layer of an inorganic compound.

This membrane was hydrolyzed in an aqueous solution containing 30 wt % of dimethyl sulfoxide (DMSO) and 15 wt % of potassium hydroxide (KOH) at a temperature of 90° C. for 60 min and, after washing with water, subjected to an equilibrium treatment at a temperature of 85° C. with a 2% solution of sodium hydrogen carbonate.

After the hydrolysis, all of sacrificial threads were dissolved, and an openness of the membrane was 80%. When a cross section of the membrane was observed after the membrane was dried, a channel was formed at the place where sacrificial threads were dissolved, and a shape of a channel was flat as same as the sacrificial threads of a multi-filament composing the reinforced cloth, and the degree of flatness thereof was 1.2. Moreover, a channel after dissolution was made to form a tubular path continuous to a warp and a weft of the cloth in the direction of the plane of the membrane.

When the surface of a film (b) was observed by an electron microscope, a minute cleft was found at the crossing point a warp and a weft of sacrificial threads.

As a method for judging a leak of an anode solution, this membrane was set in a small cell for an accelerating test, an aqueous solution of sodium chloride having a concentration of 205 g/l was circulated at 90° C. at a surface pressure of a flange of 18 kg/cm$^2$ and a pressure of air of 0.1 MPa. After 8 hours, a crystal generating from a leak of an anode solution through a channel after dissolution could not be detected. Further, in a 4×8 ft type (1.2 m×2.4 m) electrolysis cell, a cathode of overvoltage having a low hydrogen content was placed at the side containing carboxylic acid of an ion exchange membrane on which a layer of an inorganic compound was coated, and an anode of overvoltage having a low chlorine content was placed at the side containing sulfonic acid thereof, and the membrane was fastened at a surface pressure 18 kg/cm$^2$ with a hydraulic press through a gasket without applying a silicone sealant. Then, a channel after dissolution of sacrificial threads of the weft side was opened at the upper side and at the lower side of the electrolysis cell.

Then, a sodium chloride aqueous solution was supplied to the anode side while a concentration thereof was controlled at 205 g/l, and electrolysis was conducted at 40 A/dm$^2$ and a temperature of 90° C. while maintaining an alkali concentration at the side of a cathode at 32%. During the electrolysis a leak of the anode solution from the surface or the cross section of the membrane of the anode side out of the flange was not seen.

EXAMPLE 2

A plain weave reinforced cloth was weaved to obtain a composite membrane in the same way as in Example 1, except that sacrificial threads employed as weft were twisted at 30 times/m. As a result of observing a surface and a cross section of the membrane, a structure was observed wherein the shape of cross sections of almost all sacrificial threads of weft was flat in the direction of the plane of the cloth, and mono-filaments resided in a row without overlapping one another in the direction of thickness of the membrane. During the weaving of the cloth, the number of terminations owing to weft was 43 times/1000 m, and the weaving property thereof was favorable.

By using this cloth, a composite membrane was prepared in the same method and conditions as in Example 1. As a result thereof, an openness of the membrane after hydrolysis was 81%. When the membrane was dried and a cross section thereof was observed, all of sacrificial threads were found to be dissolved, and the shape of channel after dissolution of sacrificial threads was flat as same as that of sacrificial threads composing the reinforced cloth, and the degree of flatness thereof was 1.3.

Thereafter, electrolysis was conducted in the same conditions as in Example 1, and as a result thereof, during the electrolysis a leak of the anode solution from the surface or the cross section of the membrane of the anode side out of the flange was not seen.

EXAMPLE 3

A plain weave reinforced cloth was weaved to obtain a composite membrane in the same way as in Example 1, except that sacrificial threads employed as weft were twisted at 180 times/m. As a result of observing a surface and a cross section of the membrane, a structure was observed wherein the shape of cross sections of almost all sacrificial threads of weft was flat in the direction of the plane of the cloth but a portion of sacrificial threads exhibited a degree of flatness of 1.5. During the weaving of the cloth, the number of terminations owing to weft was 20 times/1000 m, and the weaving property thereof was very favorable.

Next, the composite membrane was hydrolyzed in the same method and conditions as in Example 1. As a result thereof, an openness of the membrane was 81%. When the membrane was dried and a cross section thereof was observed, all of sacrificial threads were found to be dissolved, and the shape of channel after dissolution was flat as same as that of sacrificial threads of a multi-filament composing the reinforced cloth, and the degree of flatness thereof was 1.5.

Thereafter, electrolysis was conducted in the same conditions as in Example 1, and as a result thereof, during the electrolysis a minute leak of the anode solution from the surface or the cross section of the membrane of the anode side out of the flange was seen at 8 positions of 2.4 m length. However, it was no obstacle to the operation.

EXAMPLE 4

A plain weave reinforced cloth was weaved in the same way as in Example 1, except that a taped yarn of a polytetrafluoroethylene (PTFE) of 100 denier was twisted at 1000 times/m as reinforcement threads. A thickness of the cloth was 80 $\mu$m. Thereafter, the cloth was made smooth to have a thickness of 53 $\mu$m. An openness of only reinforcement threads of PTFE of the cloth was 78%.

By using this cloth, a composite membrane was prepared in the same method and conditions as in Example 1. As a result of observing a surface and a cross section of the membrane, a structure was observed wherein the shape of the cross section of the sacrificial threads of multi-filaments was flat in the direction of the plane of the cloth, and filaments of the weft side reside in a row without overlapping one another in the direction of thickness of the membrane.

Next, the composite membrane was hydrolyzed in the same method and conditions as in Example 1. As a result thereof, an openness of the membrane was 81%. When the membrane was dried and a cross section thereof was observed, all of sacrificial threads were found to be dissolved, and the shape of channel after dissolution was flat as same as that of sacrificial threads of a multi-filament composing the reinforced cloth, and the degree of flatness thereof was 1.1.

Further, when the surface of a film (b) was observed by an electron microscope, a minute cleft was found at the crossing point of a warp and a weft of the sacrificial threads.

Thereafter, an accelerating test and electrolysis was conducted in the same conditions as in Example 1, and as a result thereof, during the electrolysis a leak of the anode solution from the surface or the cross section of the membrane of the anode side out of the flange was not seen.

EXAMPLE 5

A plain weave reinforced cloth was weaved to obtain a composite membrane in the same way as in Example 1, except that no weft was twisted. As a result of observing a surface and a cross section of the membrane, a structure was observed wherein the shape of the cross section of the sacrificial threads of a multi-filament was flat in the direction of a plane of the cloth, and filaments at the weft side resided in a row without overlapping one another in the direction of thickness of the membrane. During the weaving of the cloth, the number of terminations owing to weft was 125 times/1000 m.

By using this cloth, a composite membrane was prepared in the same method and conditions as in Example 1. As a result thereof, an openness of openings of the membrane after hydrolysis was 81%. When a cross section of the membrane was observed, all of sacrificial threads were found to be dissolved, and the shape of channel after dissolution was flat as same as that of sacrificial threads of a multi-filament composing the reinforced cloth, and the degree of flatness thereof was 1.0.

Thereafter, electrolysis was conducted in the same conditions as in Example 1, and as a result thereof, during the electrolysis a leak of the anode solution from the surface or the cross section of the membrane of the anode side out of the flange was not seen.

EXAMPLE 6

A polytetrafluoroethylene (PTFE) having a specific gravity of not lower than 2.2 was used to prepare stretched yarns of 90 denier having a circular cross section as reinforcement threads. A yarn composed of 6 filaments of a polyethylene terephthalate (PET) of 30 denier and a ratio of shrinkage in a boiling water of 8% was twisted at 10 times/m and then was sized thereon, and was employed as a warp of sacrificial threads. A yarn composed of 8 filaments of a polyethylene terephthalate (PET) of 35 denier having a ratio of shrinkage in a boiling water of 3% was twisted at 10 times/m, and was employed as a weft thereof. By employing these yarns, a plain weave reinforced cloth was weaved so as to have reinforcement threads of PTFE at 24/inch, and to have sacrificial threads of PET at 48/inch, i.e. twice that of the former. The thickness of the cloth was 100 $\mu$m. During the weaving of the cloth, the number of terminations owing to weft was 60 times/1000 m, and the weaving property thereof was almost favorable. After the weaving, a size was removed from the plain weave reinforced cloth in a deionized water at 90° C., and the cloth was dried. Then, the cloth was transferred between two heated metallic rolls for smoothing to make a thickness thereof 68 μm. An openness of only reinforcement threads of PTFE of the cloth was 79%.

By using this cloth, a composite membrane was prepared in the same method and conditions as in Example 1. As a result of observing a surface and a cross section of the membrane, a structure was observed wherein the shape of the cross section of the sacrificial threads of multi-filaments was flat in the direction of the plane of the cloth, and filaments of both warp and weft resided in a row without overlapping one another in the direction of thickness of the membrane.

Next, the composite membrane was hydrolyzed in the same method and conditions as in Example 1. As a result thereof, an openness of the membrane was 84%. When the membrane was dried and a cross section thereof was observed, all of sacrificial threads were found to be dissolved, and the shape of channel after dissolution was flat as same as that of sacrificial threads of a multi-filament composing the reinforced cloth, and the degree of flatness thereof was 1.0.

Thereafter, an accelerating test using a small cell and electrolysis was conducted in the same conditions as in Example 1, and as a result thereof, during the electrolysis a leak of the anode solution from the surface or the cross section of the membrane of the anode side out of the flange was not seen.

COMPARATIVE EXAMPLE 1

A taped yarn of a polytetrafluoroethylene (PTFE) of 200 denier was twisted at 750 times/m as a reinforce yarn. A yarn composed of 12 filaments of a polyethylene terephthalate (PET) of 30 denier having a ratio of shrinkage in a boiling water of not higher than 3% was twisted at 400 times/m to provide a sacrifice yarn as a warp and a weft. By employing these yarns, a plain weave reinforced cloth was weaved so as to have reinforcement threads of PTFE at 16/inch, and to have sacrificial threads of PET at 64/inch, i.e. 4 times that of the former. After the weaving, the cloth was transferred between two heated metallic rolls for smoothing to make a thickness thereof 100 μm. An openness of only reinforcement threads of PTFE of the cloth was 75%.

By using this cloth, a composite membrane was prepared in the same method and conditions as in Example 1. As a result of observing a surface and a cross section of the membrane, a structure was observed wherein the shape of the cross section of the sacrificial threads of multi-filaments was not flat in the direction of the plane of the cloth with filaments of both warp and weft overlapping one another but almost circular in the direction of thickness of the membrane.

Next, the composite membrane was hydrolyzed in the same method and conditions as in Example 1. As a result thereof, an openness of the membrane was 78%.

When the membrane was dried and a cross section thereof was observed, all of sacrificial threads were found to be dissolved, and the shape of channel after dissolution was circular as same as that of sacrificial threads of a multi-filament composing the reinforced cloth, and the degree of flatness thereof was 3.1.

Further, when the surface of a film (b) was observed by an electron microscope, a minute cleft was found at the crossing point of a warp and a weft of the sacrificial threads.

Thereafter, electrolysis was conducted in the same conditions as in Example 1, and as a result thereof, before conducting electric currency and during the electrolysis, a leak of the anode solution from the surface or the cross section of the membrane of the anode side out of the flange was observed at many positions at the lower side of 2.4 m length. The leak was crystallized to exhibit an icicle at some parts and the leak could not be stopped at other parts. Therefore, the operation of the electrolysis was terminated.

What is claimed is:

1. A cation exchange membrane wherein a plain weave reinforced cloth is embedded in a fluorinated polymer having a sulfonic acid group and/or a carboxylic acid group, characterized by possessing therein a tubular path which is formed in a direction of a warp and a weft of the plain weave reinforced cloth and has a cross section flat to a direction of thickness of the membrane, wherein the tubular path has a cross section having a degree of flatness of not more than 2; and wherein the tubular path has been formed by dissolution of sacrificial threads, and the sacrificial threads are of 20 to 50 denier and consist of a multi-filament composed of 4 to 8 mono-filaments of polyethylene terephthalate having a circular cross section.

2. The cation exchange membrane according to claim 1, wherein a thickness of the plain weave reinforced cloth is from 30 to 80 μm.

3. The cation exchange membrane according to claim 1, wherein reinforcement threads of the plain weave reinforced cloth are a stretched yarn of a polytetrafluoroethylene having a circular cross section and having a specific gravity of 2.0 to 2.3.

4. A process for producing a cation exchange membrane having therein a tubular path, characterized in that a plain weave reinforced cloth which has been mixedly weaved with reinforcement threads and sacrificial threads, and wherein the sacrificial threads are flat parallel to a plane of the cloth, or mono-filaments composing the sacrificial threads reside in a row without overlapping one another in a direction of thickness of the cloth, is embedded in a fluorinated polymer having a sulfonic acid group and/or a carboxylic acid group, to form a membrane, and thereafter the membrane is hydrolyzed and at the same time the sacrificial threads are dissolved with an acid or an alkali, wherein the tubular path has a cross section having a degree of flatness of not more than 2; and wherein the sacrificial threads of the warp are twisted not higher than 250 times/m, and the sacrificial threads of the weft are twisted not higher than 200 times/m, and wherein the sacrificial threads are of 20 to 50 denier and consist of a multi-filament composed of 4 to 8 mono-filaments of polyethylene terephthalate having a circular cross section.

5. The process for producing a cation exchange membrane according to claim 4, wherein the sacrificial threads are composed of a multi-filament of polyethylene terephthalate.

6. The process for producing a cation exchange membrane according to claim 4, wherein the sacrificial threads are of 20 to 50 denier and consist of a multi-filament composed of 4 to 8 mono-filaments and having a circular cross section.

7. The process for producing a cation exchange membrane according to claim 4, wherein a shrinkage ratio of the sacrificial threads of the warp in boiling water is not lower than 6%, and a shrinkage ratio of the sacrificial threads of the weft in boiling water is not higher than 3%.

8. The process for producing a cation exchange membrane according to claim 4, wherein a number of twisting of the sacrificial threads of the weft is higher than 0 times/m and not higher than 100 times/m.

9. The process for producing a cation exchange membrane according to claim 4, wherein a thickness of the plain weave reinforced cloth is 30 to 80 $\mu$m.

10. A precursor of a cation exchange membrane wherein a plain weave reinforced cloth which, by employing sacrificial threads having a number of twisting of not higher than 250 times/m as a warp, and sacrificial threads having a number of twisting of not higher than 200 times/m as a weft, has been prepared by mixedly weaving them with reinforcement threads, is embedded in a fluorinated polymer having a sulfonic acid group and/or a carboxylic acid group, and the sacrificial threads are flat parallel to a plane of the membrane, or mono-filaments composing the sacrificial threads reside in a row without overlapping one another in a direction of thickness of the membrane and are in a continuous form in a direction of each of the warp and the weft of the cloth, and sacrificial threads are of 20 to 50 denier and consist of a multi-filament composed of 4 to 8 monofilaments of polyethylene terephthalate having a circular cross section.

* * * * *